US008015755B2

(12) United States Patent
Miller et al.

(10) Patent No.: US 8,015,755 B2
(45) Date of Patent: Sep. 13, 2011

(54) INTEGRATED HOUSING MOUNTING SYSTEM

(76) Inventors: Bradley Miller, Milwaukee, WI (US); Thomas DeFer, Milwaukee, WI (US)

( * ) Notice: Subject to any disclaimer, the term of this patent is extended or adjusted under 35 U.S.C. 154(b) by 0 days.

(21) Appl. No.: 12/582,631

(22) Filed: Oct. 20, 2009

(65) Prior Publication Data

US 2011/0088335 A1 Apr. 21, 2011

(51) Int. Cl.
*E04D 13/15* (2006.01)

(52) U.S. Cl. ..... 52/97; 52/94; 52/716.1; 52/60; 248/227.4; 362/145; 362/147; 362/152

(58) Field of Classification Search ..... 52/97, 58, 52/94, 287.1, 716.1, 836, 846, 60; 362/145, 362/147, 149, 151, 152; 248/340, 214, 215, 248/227.4, 915
See application file for complete search history.

(56) References Cited

U.S. PATENT DOCUMENTS 3,193,229 A * 7/1965 Stock
3,599,916 A * 8/1971 Szabo ..... 248/73
4,974,128 A * 11/1990 Prickett
5,141,192 A * 8/1992 Adams
5,566,058 A * 10/1996 Protz, Jr.
5,707,136 A * 1/1998 Byers
6,050,709 A * 4/2000 Hastings ..... 362/375
D427,510 S * 7/2000 Gary et al.
6,109,765 A * 8/2000 Blanton
6,364,508 B1 * 4/2002 Moreland
D460,912 S * 7/2002 Gary et al.
6,644,836 B1 * 11/2003 Adams
6,652,112 B1 * 11/2003 Lucarelli
6,827,379 B2 * 12/2004 Hill et al.
6,955,458 B2 * 10/2005 Cheema ..... 362/581
7,066,618 B1 * 6/2006 Little
7,159,998 B2 * 1/2007 Moreland
7,188,977 B1 * 3/2007 Lough
7,306,354 B2 * 12/2007 Haas ..... 362/432
7,513,643 B2 * 4/2009 Williams ..... 362/249.01
7,770,859 B2 * 8/2010 Costabel et al. ..... 248/316.5
2002/0186562 A1 * 12/2002 Schroetter ..... 362/249
2003/0066938 A1 * 4/2003 Zimmerman ..... 248/301
2004/0257801 A1 * 12/2004 Cheema ..... 362/152
2005/0166529 A1 * 8/2005 Rodolofo et al. ..... 52/716.1
2009/0086471 A1 * 4/2009 Bollman ..... 362/152
2010/0200713 A1 * 8/2010 Miller et al. ..... 248/220.21

OTHER PUBLICATIONS

Up-N-Away Track System Advertisement, Internet Publication Date at least as early as Dec. 31, 2007, accessible via the internet achive WayBackMachine (http://web.archive.org) (last visited Feb. 28, 2011), 7 pages.*
Online sales literature for Track-System; Oct. 8, 2009, http://www.up-n-awaytrack.com (reference enclosed).

* cited by examiner

*Primary Examiner* — Brian Glessner
*Assistant Examiner* — Rodney Mintz
(74) *Attorney, Agent, or Firm* — Absolute Technology Law Group, LLC

(57) ABSTRACT

The present invention is an integrated housing mounting system for mounting ornamentation to buildings. Mount components are attached to a building in place of J-channel, J molding, drip edge, gutter apron or siding. Rail components are assembled to the desired length using connector components and lights or signage are attached to a rail component using hooks. A guide member is placed at each end of the assembled rail and the rail is guided through an opening in the mount component securing the lights or signage to the building. The rail components are then guided through an opening in the mount component.

17 Claims, 12 Drawing Sheets

INTEGRATED HOUSING MOUNTING SYSTEM

CROSS-REFERENCE TO RELATED APPLICATIONS

This application claims priority to U.S. Provisional Application No. 61/150,529 filed on Feb. 6, 2009 and is related to U.S. Non-provisional application Ser. No. 12/576,411 filed on Oct. 9, 2009.

FIELD OF INVENTION

The present invention relates to the field of siding and exterior ornamental housing accessories.

GLOSSARY

Figure 1A:
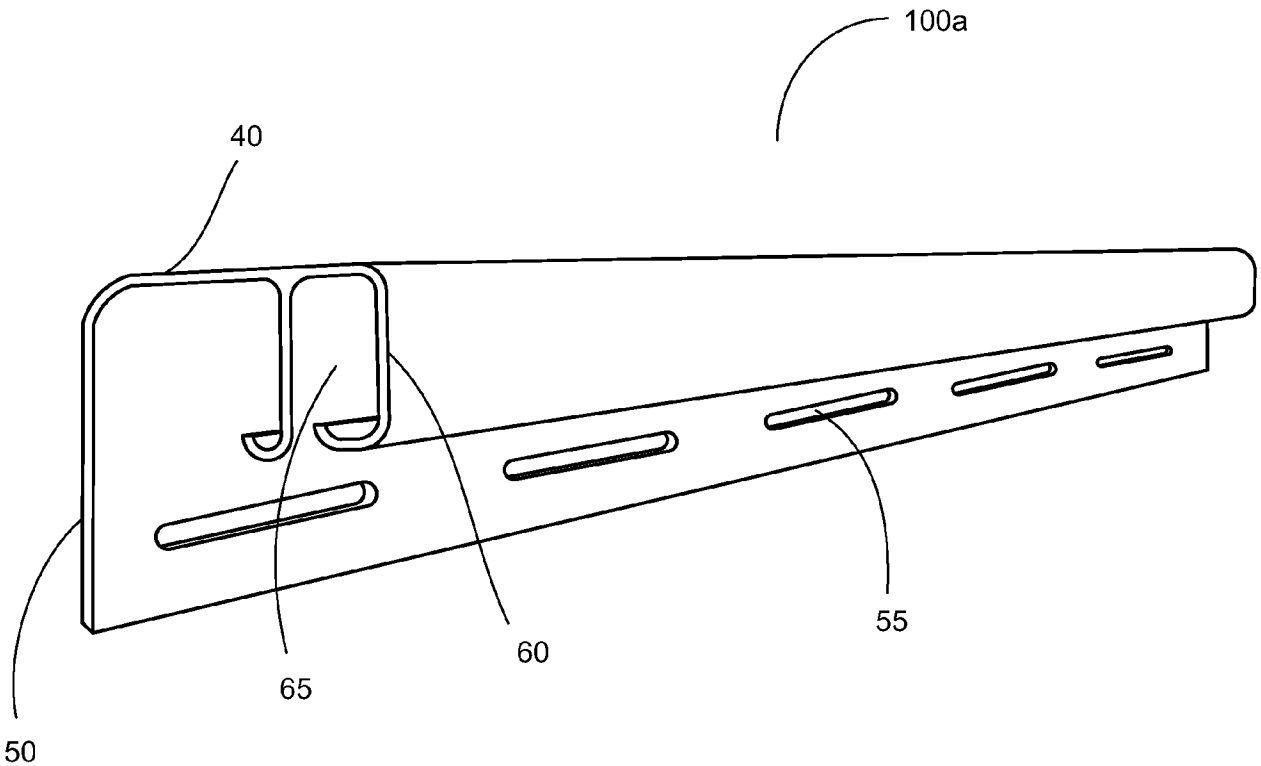
FIG. 1*a* illustrates a perspective view of an exemplary embodiment of a mount component for mounting ornamentation to a surface of a building.

As used herein, the term "mount component" refers a component of an integrated housing mounting system that attaches to a structural component of a building and is adapted to receive a rail component.

As used herein, the term "rail component" refers to a component to which lighting or signage is attached and which is received by a mount component.

As used herein, the term "j-channel" refers to a style of siding that is used to trim out the ends of siding panels where they meet a door or window and to cover cut edges of panels around windows and under eaves.

As used herein, the term "j molding" refers to a type of molding used to present a finished edge on vinyl or aluminium siding. J molding is often used around window and door casings and at the top edge and bottom of siding to hold siding in place.

As used herein, the term "drip edge" refers to a modified L-shaped component used along the eaves and rakes of a roof to direct runoff water.

As used herein, the term "gutter apron" refers to a modified L-shaped component having a inside angle of 95 to 120 degrees used along the eaves and rakes of a roof to direct water into the gutter and away from the fascia.

As used herein, the term "semi-rigid" refers to a material that is moderately or somewhat capable of being bent without breaking.

As used herein, "weather resistant" refers to a material that is capable of withstanding extreme cold and is protected against UV exposure.

BACKGROUND

More than 80 million Americans mount lighting, signage or other ornamentation on their homes each year. Many homes have siding, drip edge and gutter apron components on their roofs.

Drip edge and gutter aprons are roofing components which are often used in addition to a gutter, and which are well-known in the art.

Generally, siding, drip edge and gutter apron components must be professionally installed and require the use of a ladder.

Signage and other ornamentation also require substantial labor to install; although, it is often a temporary and interchangeable component. Most consumers find installation and removal of these components to be time consuming and dangerous, particularly as these items may be seasonal or otherwise require change.

It is desirable to have an integrated housing mounting system for mounting ornamentation which utilizes other housing components known in the art such as siding, drip edge and gutter apron.

It is further desirable to have a mounting system which allows the appearance of temporary lighting and signage components to be minimized when not in use.

SUMMARY OF THE INVENTION

The present invention is an integrated housing mounting system for mounting ornamentation which replaces standard drip edge, gutter apron and siding components known in the art to enable temporary lighting and ornamentation to be adapted and changed without use of a ladder after initial installation.

A mount component which replaces a siding, drip edge or gutter apron component known in art is attached to a building in place of J-channel, J molding, drip edge, gutter apron or other siding piece. A rail component is assembled by connecting individual rail components using connector components. Light strands are attached to a rail component by hooks which are hooked through accessory mount holes. An insertion component is attached to the leading end of a rail component and the hollow channel portion of the rail component is inserted in the opening of the mount component. A second insertion component is attached to the trailing end. A pole is hooked through a guiding hole at the lead end of the rail component and is used to guide rail component through the mount component. Once installed, end caps can be used to enclose the opening of the mount component.

To remove the lights, the end caps are removed and a pole is attached to the lead end of the rail component. The rail component can then be pulled out of the mount component. The light strand can be easily removed from the rail component and replaced with another strand of lights.

DETAILED DESCRIPTION OF INVENTION

For the purpose of promoting an understanding of the present invention, references are made in the text to exemplary embodiments of an integrated housing mounting system for mounting ornamentation, only some of which are described herein. It should be understood that no limitations on the scope of the invention are intended by describing these exemplary embodiments. One of ordinary skill in the art will readily appreciate that alternate but functionally equivalent components, materials and positioning may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1*a* illustrates a perspective view of an exemplary embodiment of mount component 100*a* for mounting to a surface of a building, for example, mount component 100*a* may be used in place of traditional or standard J-channel or J molding. Mount component 100*a* is comprised of top portion 40, back portion 50, contoured track mount housing 60 and apertures 55 (which may be slots, holes or pads adapted to receive adhesive in various embodiments) for securing mount component 100*a* to a building (e.g., with nails, screws, caulk, bolts, staples, pins, adhesives or other means known in the art.) In the exemplary embodiment shown, mount component 100*a* is secured to a building using nails or screws.

In the embodiment shown, mount component 100*a* is comprised of a semi-flexible polyvinyl chloride (PVC) that is weather resistant and which is made by extrusion. In other embodiments, mount component 100*a* may be comprised of another type of plastic (e.g., polystyrene, nylon), rubber, metal or any other semi-flexible material and may be machined, molded, cast, stamped or bent.

Figure 5:
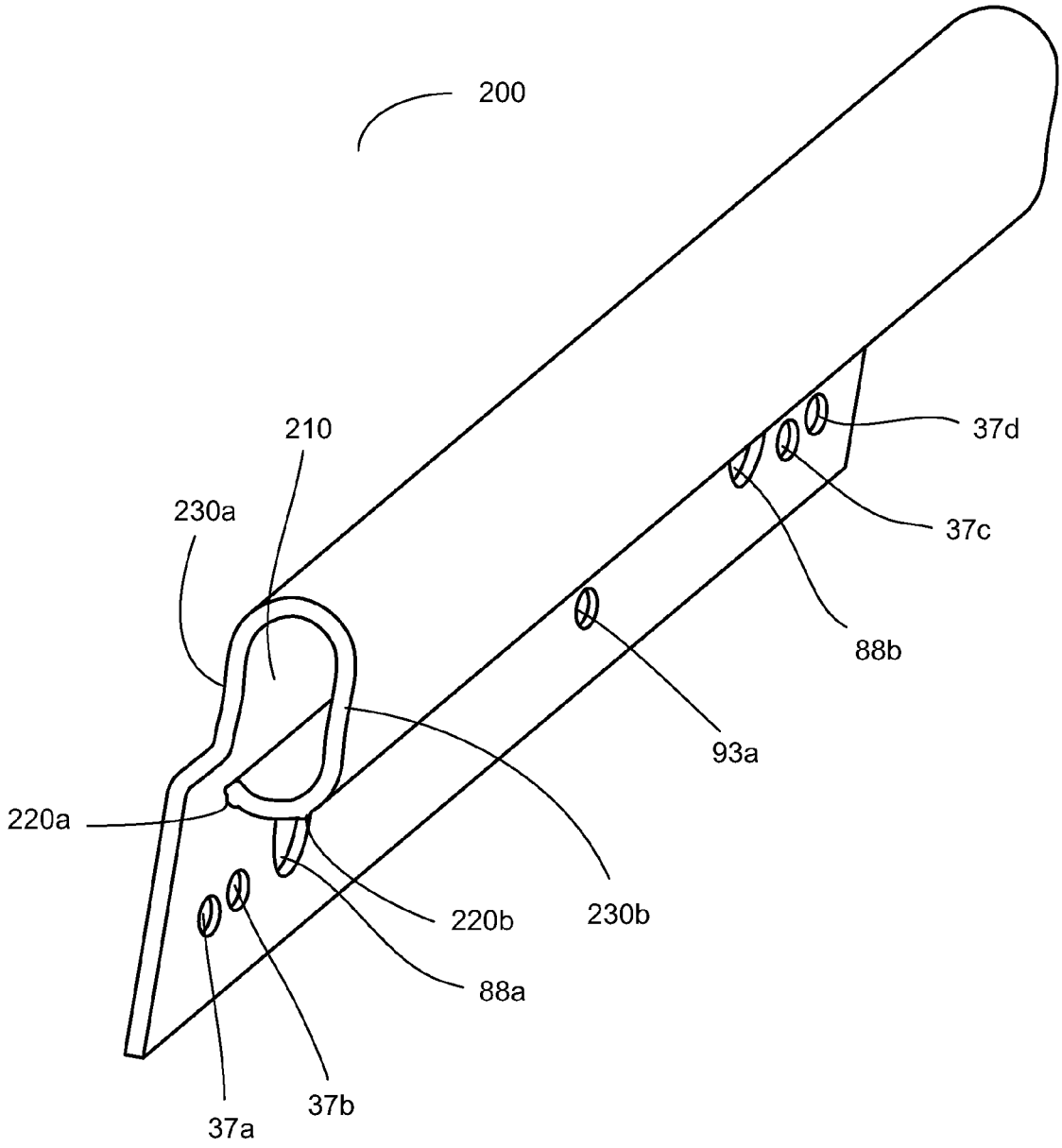
FIG. 5 illustrates a perspective view of an exemplary embodiment of a rail component.

Contoured track mount housing 60 forms opening 65 which is shaped to accommodate rail component 200 (FIG. 5). In the embodiment shown, opening 65 is oval shaped. In other embodiments, opening 65 can be of any shape which conforms to structural contours 230*a*, 230*b* of rail component 200.

In an exemplary embodiment, mount component 100*a* comes in 8 foot sections; however, it may be available in lengths shorter or longer than 8 feet. In addition, mount component 100*a* is available in a variety of colors to match the color of commercially available gutters.

Figure 1B:
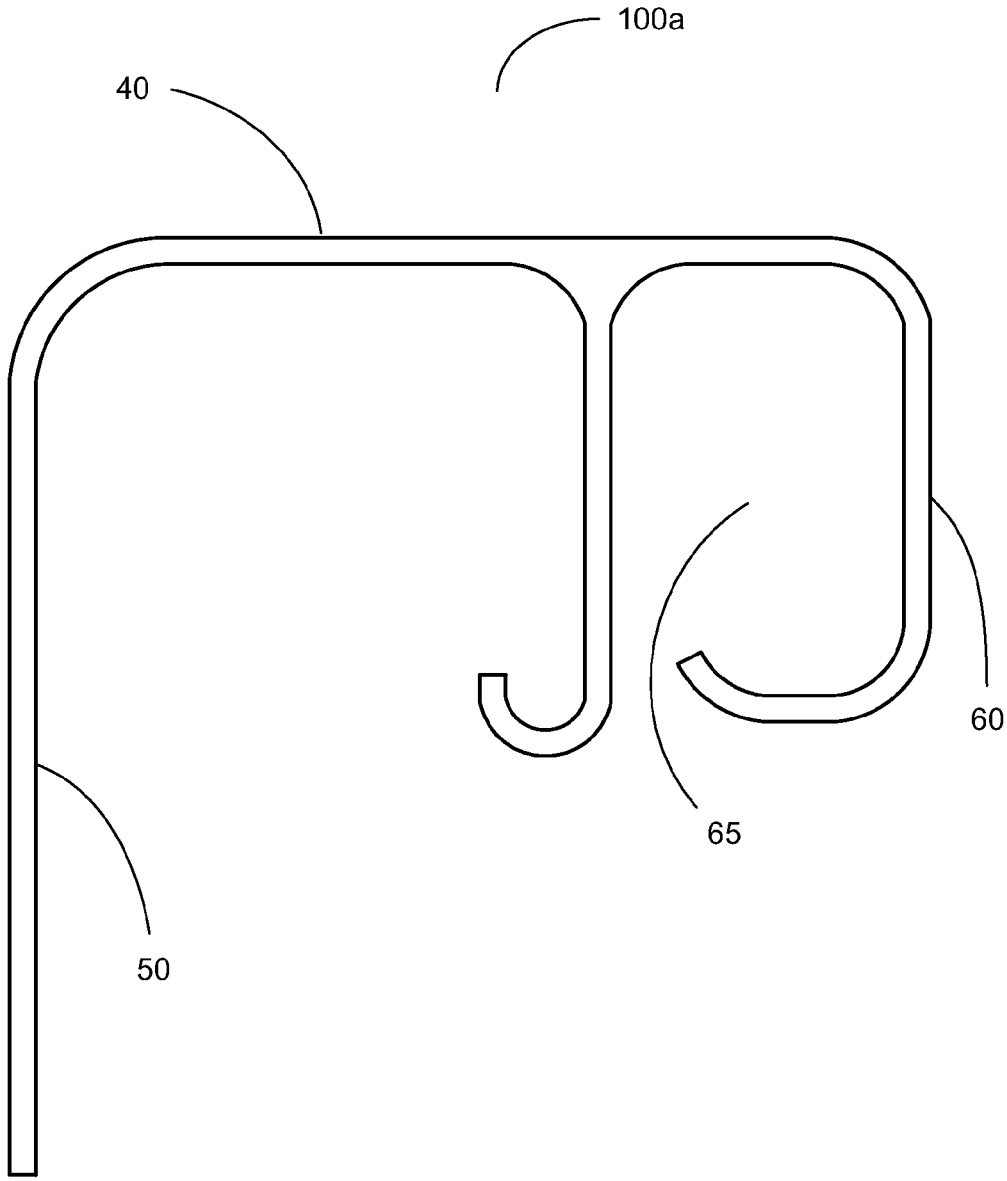
FIG. 1*b* illustrates a side view of an exemplary embodiment of a mount component for mounting ornamentation to a surface of a building.

FIG. 1*b* illustrates a side view of an exemplary embodiment of mount component 100*a*. Apparent in FIG. 1*b* is opening 65 which has a shape/contour adapted to receive accommodate rail component 200.

Figure 2A:
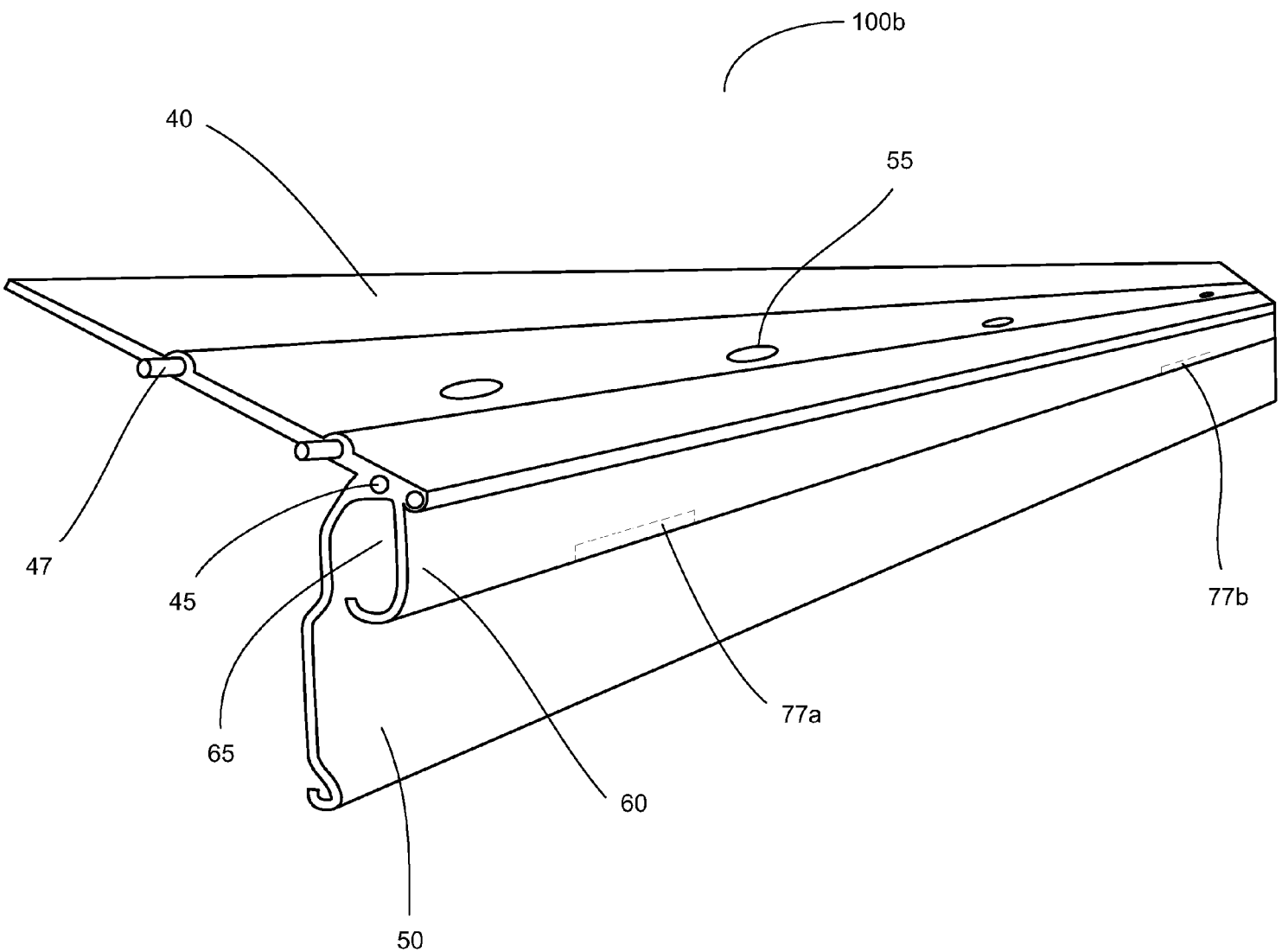
FIG. 2*a* illustrates a perspective view of an exemplary embodiment of a combination mount component and gutter apron component for use on a building roof.

FIG. 2*a* illustrates a perspective view of an exemplary embodiment of mount component 100*b* for use in place of a gutter apron. Mount component 100*b* is designed to be installed during the roofing process under the shingles along the lower edge of a roof. Mount component 100*b* is comprised of top portion 40, back portion 50 and contoured track mount housing 60. Top portion 40 includes apertures 55 for securing component to the roof. After mount component 100*b* is installed, roof shingles are placed over top portion 40.

In the embodiment shown, the angle between top portion 40 and back portion 50 is approximately 120 degrees. In other embodiments, the angle may be smaller or greater.

In the embodiment shown, mount component 100*b* is comprised of a semi-flexible polyvinyl chloride (PVC) that is weather resistant and which is made by extrusion. In other embodiments, mount component 100*b* may be comprised of another In the embodiment shown, top portion 40 further includes apertures 45. Mount components 100*b* are connected by inserting pins 47 into apertures 45. Pins 47 interlock two mount components 100*b* forming a continuous gutter apron. In other embodiments, mount components 100*b* may be connected using another means, such as adhesive.

Contoured track mount housing 60 forms opening 65 which is shaped to accommodate rail component 200 (FIG. 5). In the embodiment shown, opening 65 is oval shaped. In other embodiments, opening 65 can be of any shape which conforms to structural contours 230*a*, 230*b* of rail component 200.

In the embodiment shown, back portion 50 has a height of 6 inches and is curved. In other embodiments, the height and/or shape of back portion 50 varies.

Figure 2B:
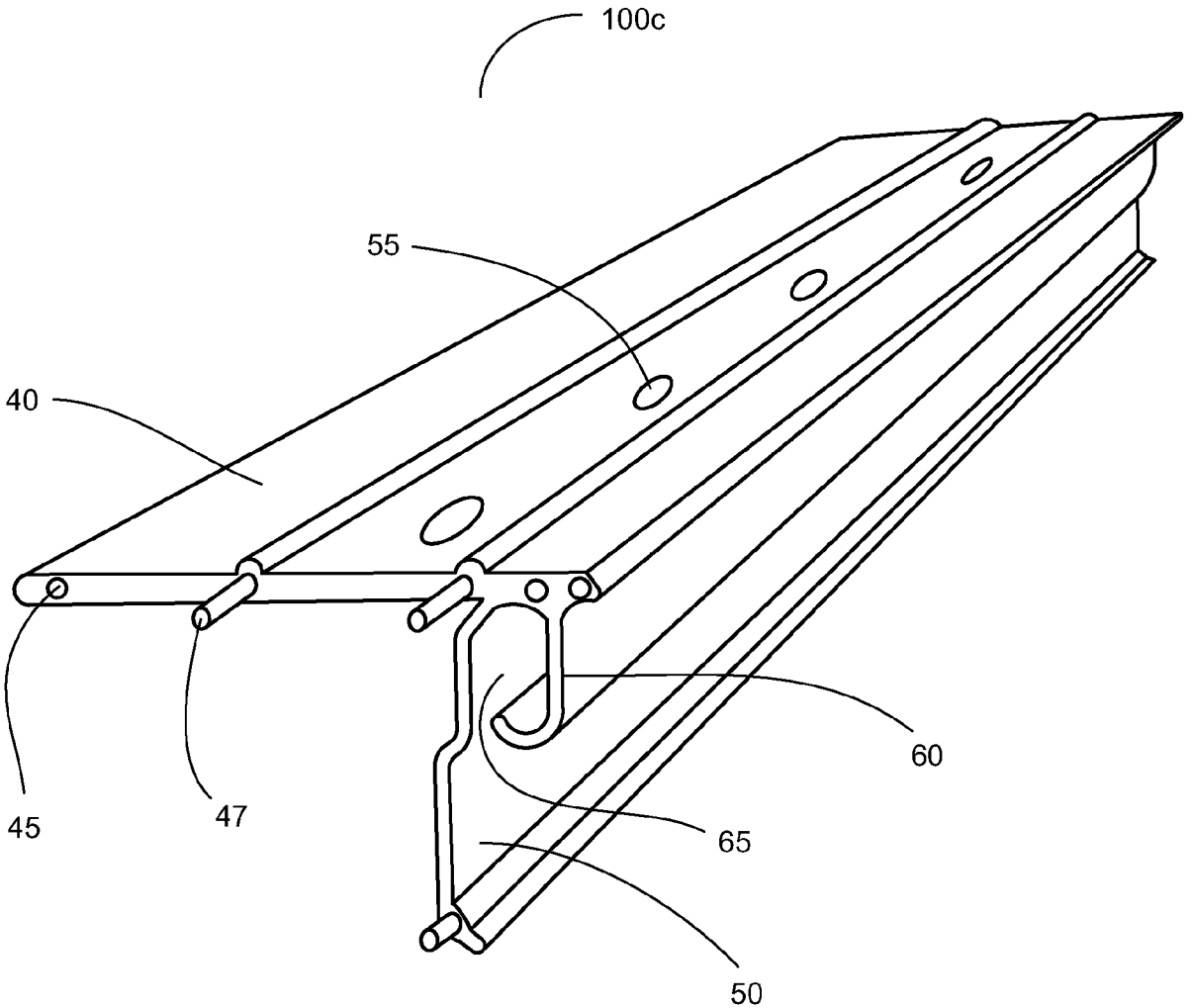
FIG. 2*b* illustrates a side view of an exemplary embodiment of a combination mount component and drip edge component for use on a building roof.

FIG. 2*b* illustrates a side view of an exemplary embodiment of mount component 100*c* for use in place of drip edge. Mount component 100*c* is designed to be installed during the roofing process under the shingles along the lower edge of a roof and along the rakes of the roof. Mount component 100*c* is comprised of top portion 40, back portion 50 and contoured track mount housing 60. Top portion 40 includes apertures 55 for securing component to the roof. After mount component 100*b* is installed, roof shingles are placed over top portion 40.

In the embodiment shown, the angle between top portion 40 and back portion 50 is 90 degrees. In other embodiments, the angle may be smaller or greater.

Figure 3A:
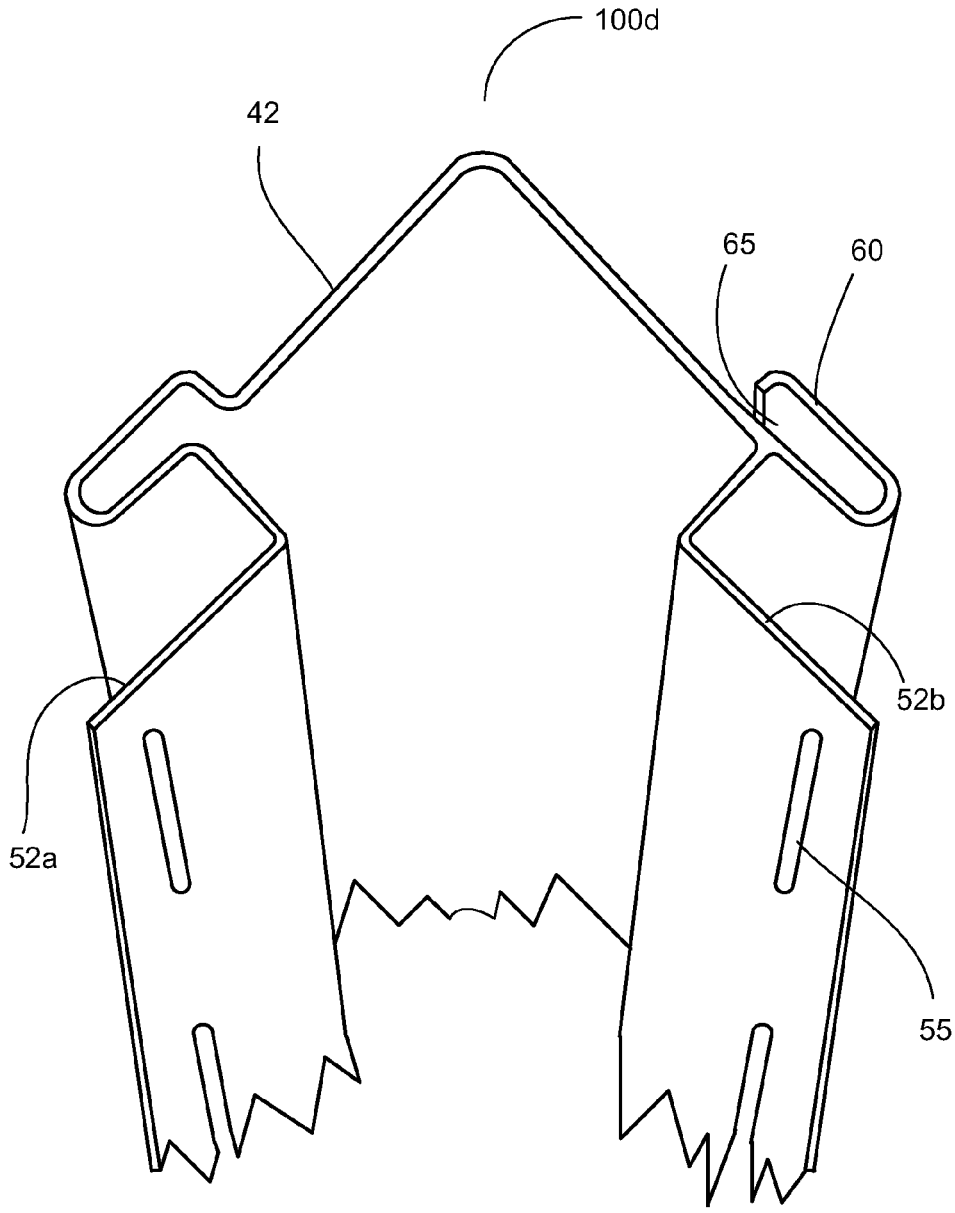
FIG. 3*a* illustrates a perspective view of an exemplary embodiment of a combination mount component and siding component which is secured to an outside 90 degree corner of a building.

FIG. 3*a* illustrates a side view of an exemplary embodiment of mount component 100*d* for use in place of vertical outside corner pieces used with siding. Mount component 100*d* is comprised of corner portion 42, side portions 52*a*, 52*b* and contoured track mount housing 60. Corner portion 42 conforms to the outside corner of the building. Side portions 52*a*, 52*b* further include apertures 55 for securing mount component 100*d* to sides of a building. In an exemplary embodiment, mount component 100*d* is secured to a building using nails or screws.

In the embodiment shown, mount component 100*d* is comprised of a semi-flexible polyvinyl chloride (PVC) that is weather resistant and which is made by extrusion. In other embodiments, mount component 100*c* may be comprised of another type of plastic (e.g., polystyrene, nylon), rubber, metal or any other semi-flexible material and may be machined, molded, cast, stamped or bent.

Contoured track mount housing 60 forms opening 65 which is shaped to accommodate rail component 200 (FIG.

5). In the embodiment shown, opening 65 is oval shaped. In other embodiments, opening 65 can be of any shape which conforms to structural contours 230*a*, 230*b* of rail component 200.

In an exemplary embodiment, mount component 100*d* comes in 8 foot sections; however, it may be available in lengths shorter or longer than 8 feet. In addition, mount component 100*d* is available in a variety of colors to match the color of commercially available gutters.

Mount component 100*d* further includes access openings 77*a*, 77*b* (not visible) which enable curved rail component 300 (FIG. 3*c*) to be inserted into opening 65. One skilled in the art will readily understand that as a result of the location of mount component 100*d*, the rail component must be bent when inserted into opening of mount component 100*d*, and that rail component cannot be inserted as a continuous straight vertical piece.

Figure 3B:
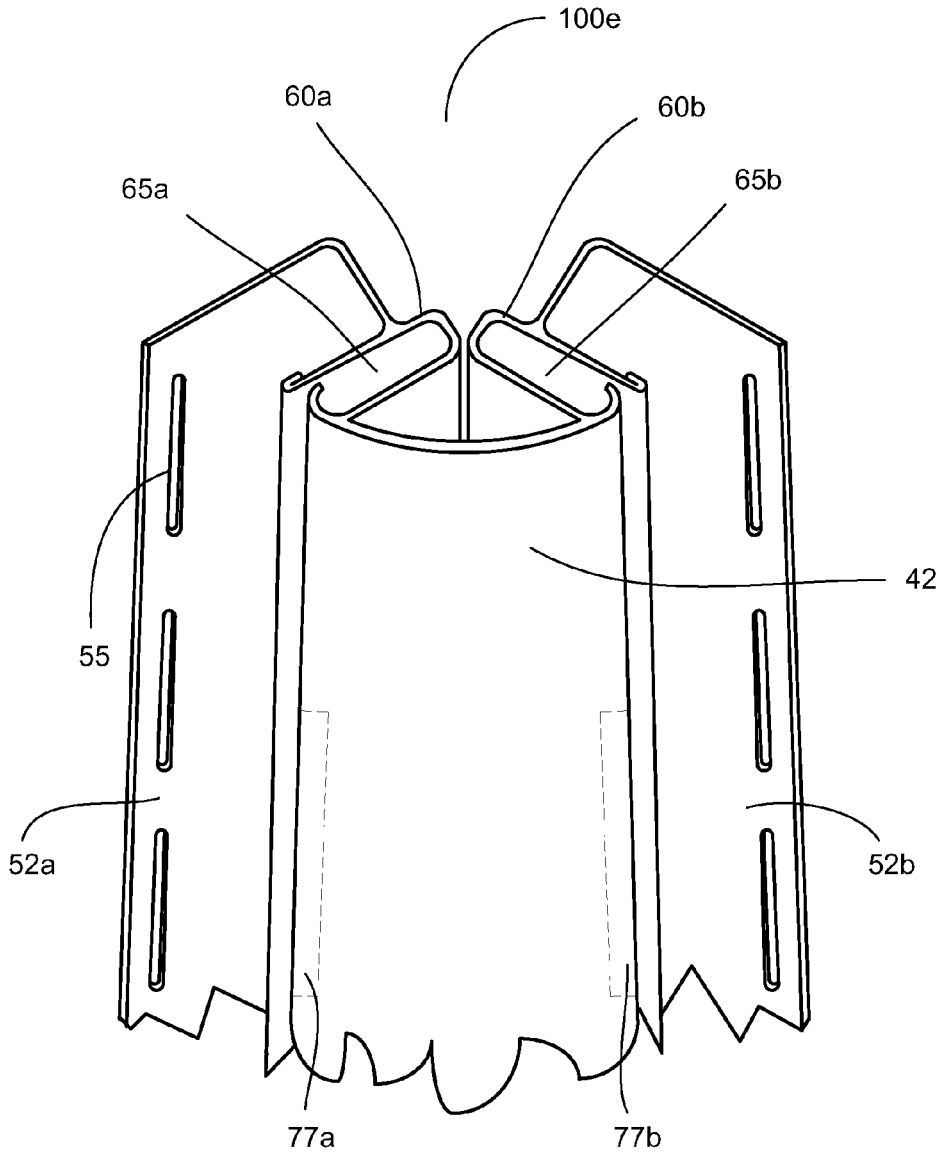
FIG. 3*b* illustrates a perspective view of a second exemplary embodiment of a combination mount component and siding component which is secured to an inside 90 degree corner of a building.

FIG. 3*b* illustrates a side view of an exemplary embodiment of mount component 100*e* for use in place of vertical insides corner pieces used with siding. Mount component 100*e* is comprised of corner portion 42, side portions 52*a*, 52*b* and contoured track mount housings 60*a*, 60*b*. Corner portion 42 fits into the inside corner of a building. Side portions 52*a*, 52*b* further include apertures 55 for securing mount component 100*e* to sides of a building. In an exemplary embodiment, mount component 100*e* is secured to a building using nails or screws.

Also visible are access openings 77*a*, 77*b* (not visible) which enable flexible rail component 250 (not shown) to be inserted into openings 65*a*, 65*b* formed by contoured track mount housing 60*a*, 60*b*.

Figure 3C:
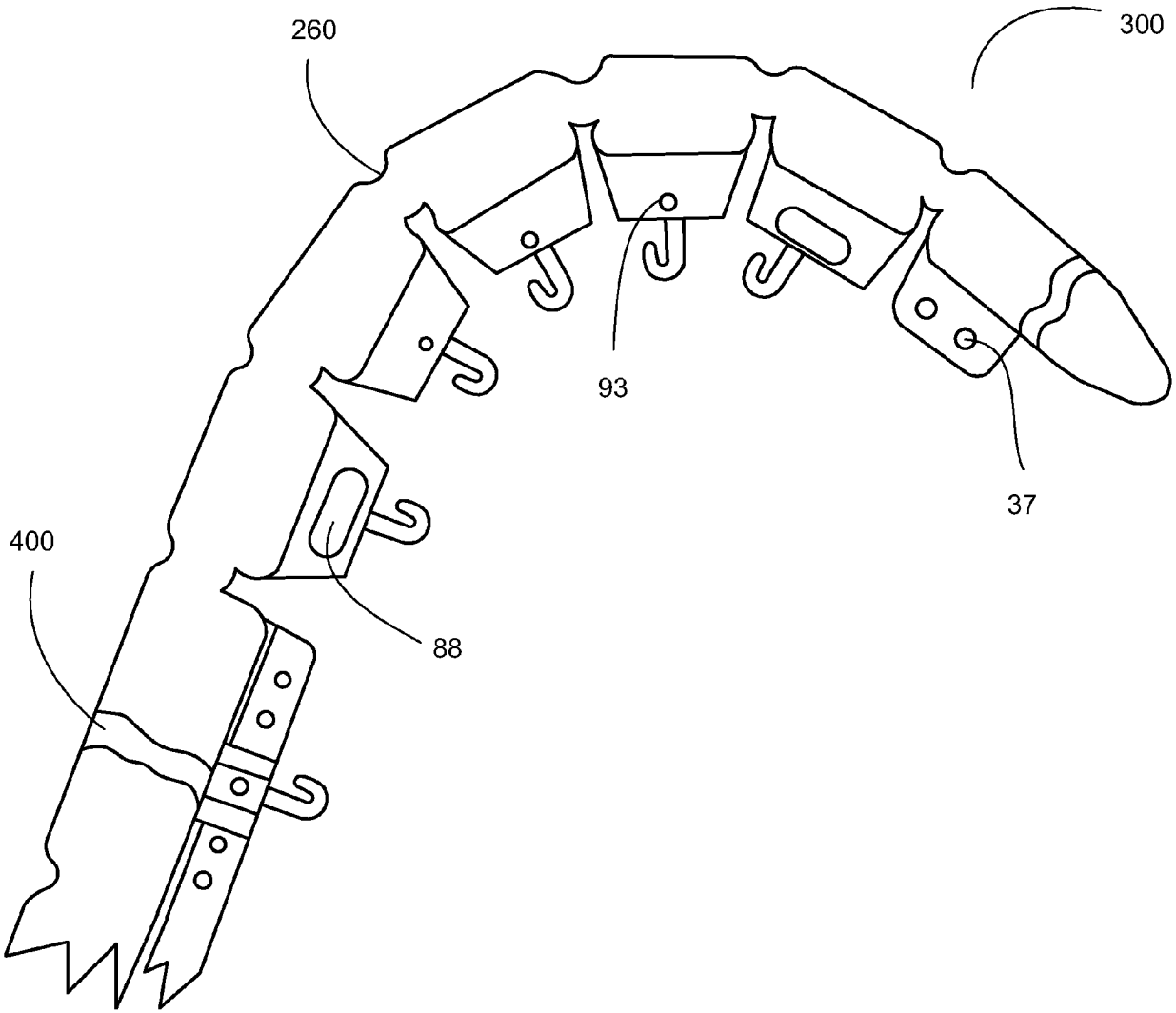
FIG. 3*c* illustrates a perspective view of an exemplary embodiment of a curved rail component.

FIG. 3*c* illustrates curved rail component 300 for insertion into mount component 100. In the embodiment shown, curved rail component 300 is flexible with joints 260 which are pivotal to form angles to facilitate insertion of curved rail component into a straight position within contoured track mount housing 60 (not shown). Also visible is connector component 400 which connects two rail components.

Figure 3D:
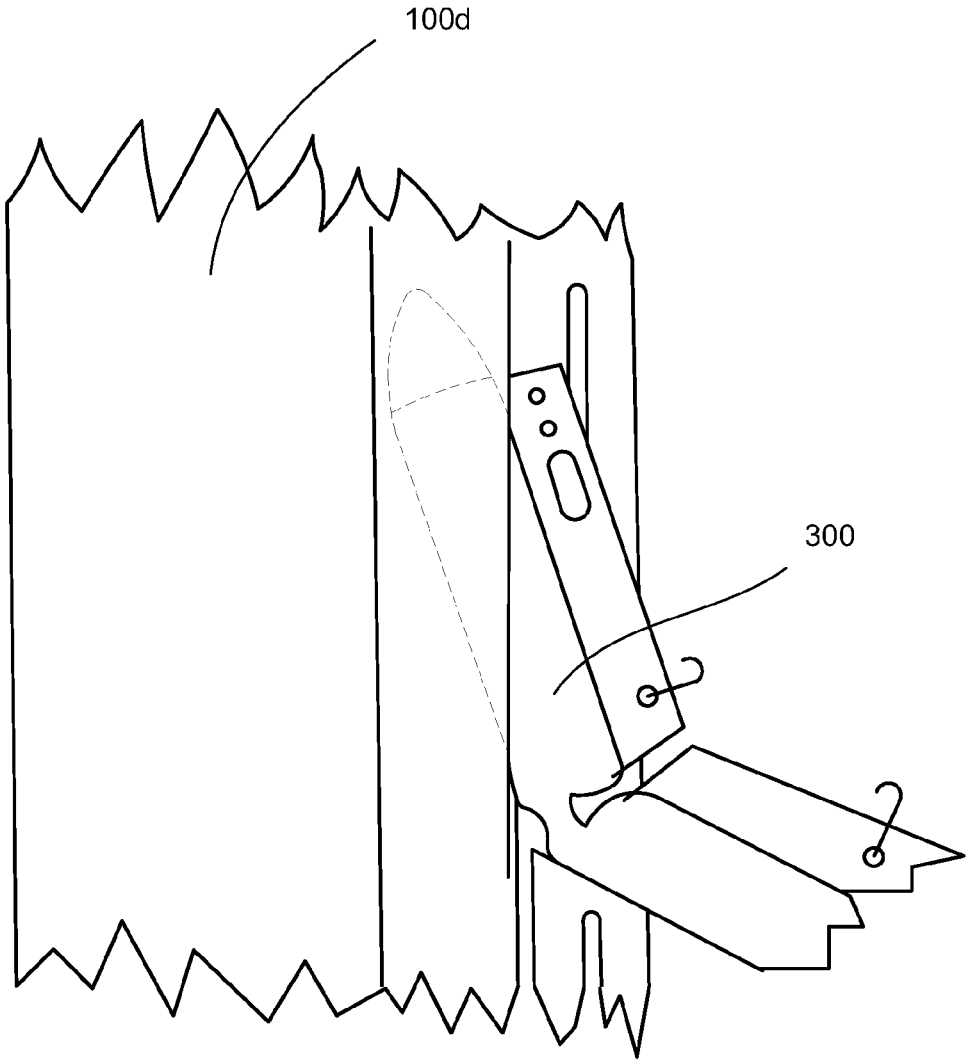
FIG. 3*d* illustrates a perspective view of an exemplary embodiment of a curved rail component being inserted into a combination mount component and siding component secured to an outside 90 degree corner of a building.

FIG. 3*d* illustrates curved rail component 300 being inserted into mount component 100*d*, a combination mount component and siding component. In the embodiment shown, mount component 100*d* is secured to an outside 90 degree corner of a building.

Figure 4:
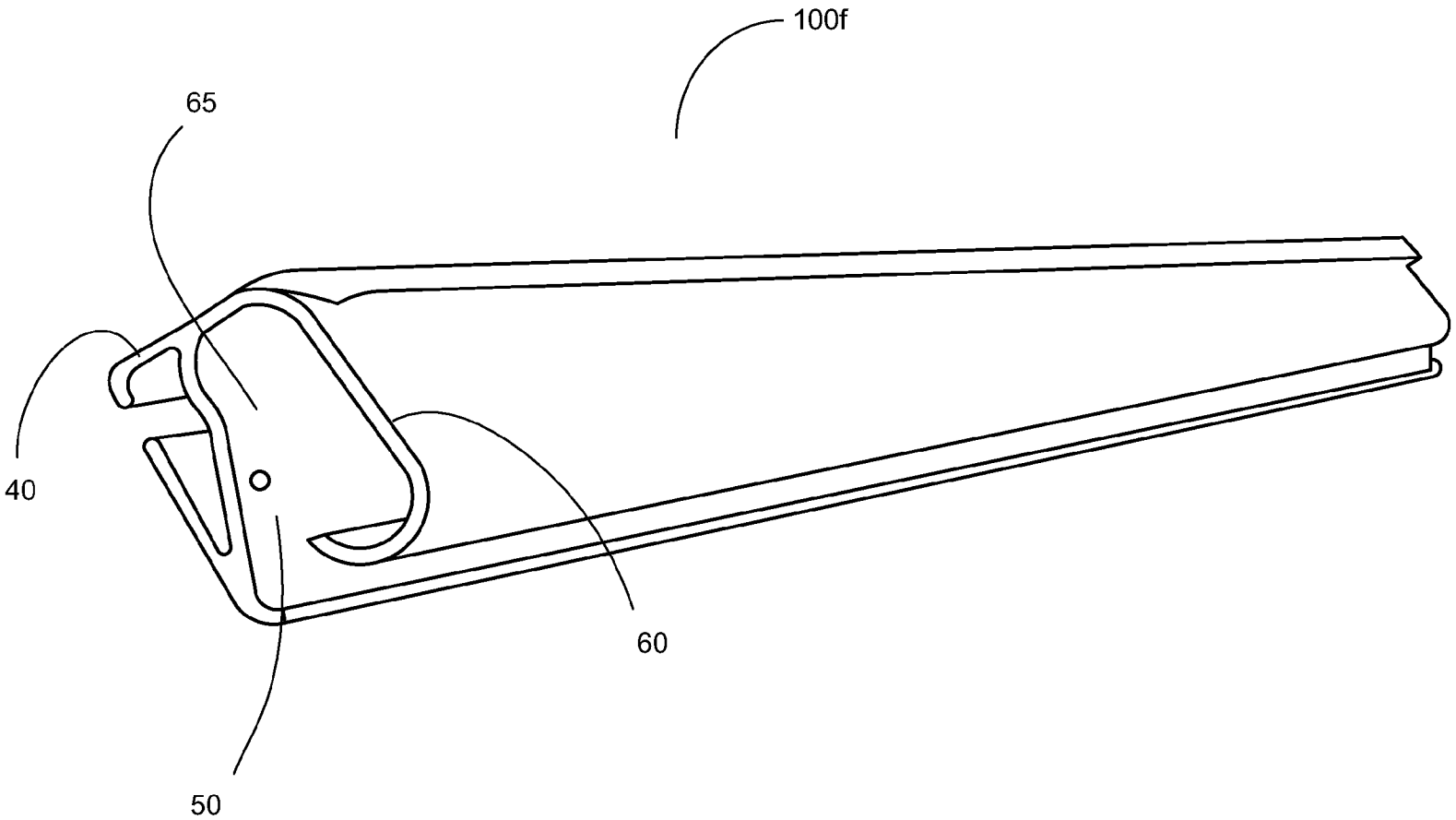
FIG. 4 illustrates a perspective view of a mount component to used be used with existing drip edge.

FIG. 4 illustrates a perspective view of mount component 100*f* used with existing drip edge. Mount component 100*f* is comprised top portion 40, back portion 50 and contoured track mount housing 60 which forms opening 65. Mount component 100*f* further includes access openings 77*a*, 77*b* (not visible) which enable curved rail component 300 (FIG. 3*c*) to be inserted into openings 65*a*, 65*b* formed by contoured track mount housing 60*a*, 60*b* and apertures 55 for securing mount component 100*f* to a building. In an exemplary embodiment, mount component 100*f* is secured to a building using nails or screws.

In the embodiment shown, access openings 77*a*, 77*b* are approximately 6 to 8 inches from each end and are 5 to 6 inches long. In other embodiments, there are more or fewer access openings. In addition, the location and length of access openings may vary.

FIG. 5 illustrates a perspective view of an exemplary embodiment of rail component 200 for integrated housing mounting system. The shape of rail component 200 conforms to the shape of contoured track mount housing 60 of mount component 100 and is slightly smaller in dimension so that rail component 200 can be slid inside opening 65 formed by contoured track mount housing 60.

Structural contours 230*a*, 230*b* of rail component 200 form hollow channel 210 which is adapted to receive connector component 400 (not shown). Structural contours 230*a*, 230*b* are slightly smaller in dimension than contoured track mount housing 60 so that rail component can slide within mount component 100. The slight curvature of structural contours 230*a*, 230*b* in the embodiment shown permit slight movement of rail component 200 to accommodate weight of lights or signage, but prevent pivoting of rail component 200 when secured to mount component 100.

Structural contour 230*a* has friction reducing ridges 220*a*, 220*b* which reduce friction between rail component 200 and inner surface of contoured track mount housing 60 (not shown). Friction reducing ridges 220*a*, 220*b* also allow for expansion and contraction while securing mount component 100 allowing rail component to be removed in all weather conditions, i.e., prevent rail component 200 from being stuck inside mount component 100.

Rail component 200 further includes apertures 37*a*, 37*b*, 37*c*, 37*d* adapted to receive pins of connector component 400, guiding holes 88*a*, 88*b* for connecting pole 80 (not shown) and accessory mount hole 93*a* for securing accessories (e.g., string of light or signage). In other embodiments, rail component 200 may have more or fewer apertures, guiding holes, and/or accessory mount holes or have them in varying locations.

In the embodiment shown, guiding holes 88*a* and 88*b* are used to insert a pole, but in other embodiments may be used to attach other implements, such as a rope or wire.

Figure 6:
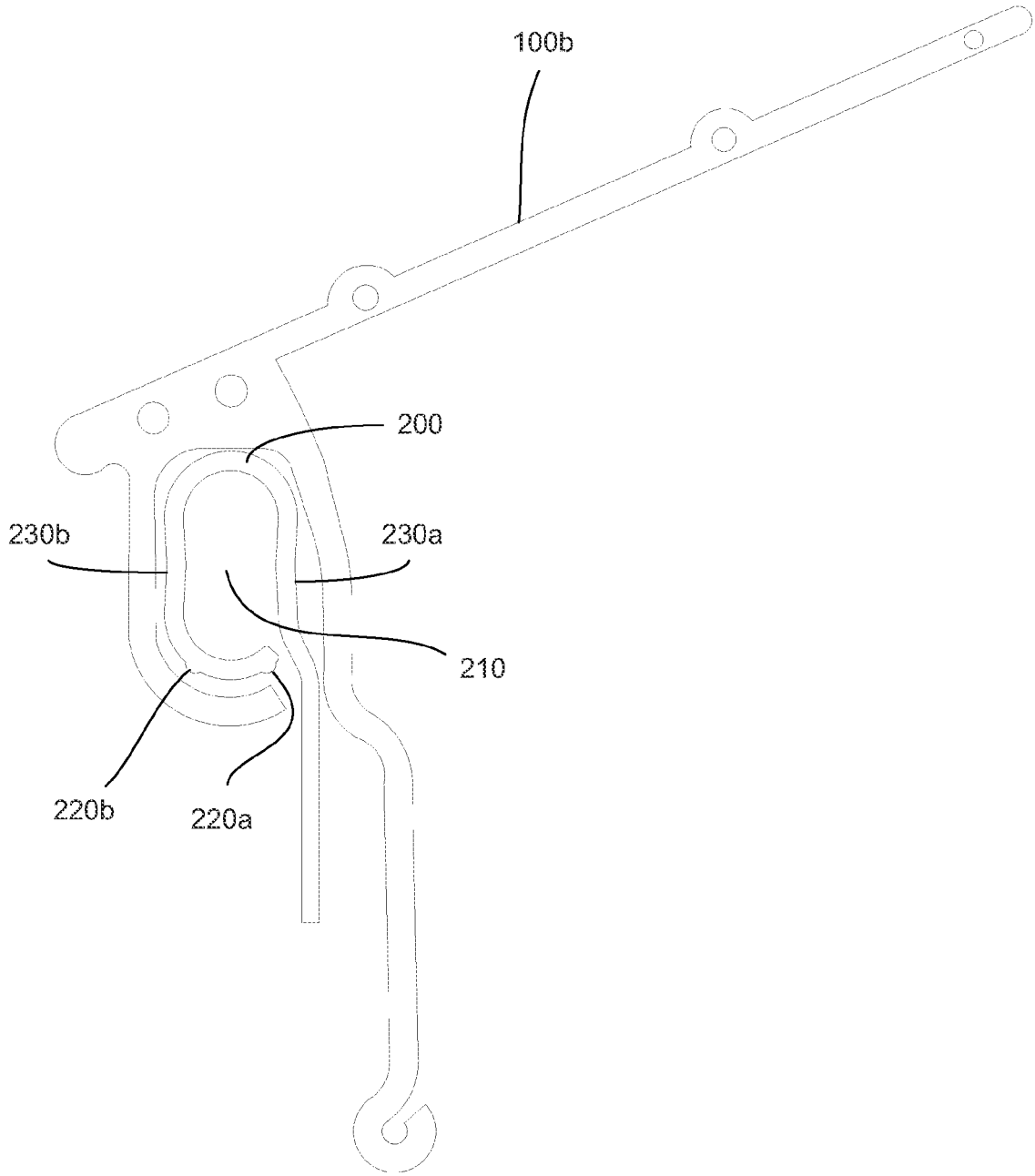
FIG. 6 illustrates a side view of an exemplary embodiment of a rail component inserted into a combination mount component and gutter apron component.

FIG. 6 illustrates a side view of an exemplary embodiment of rail component 200 inserted into mount component 100*b*, a combination mount component and gutter apron component.

Figure 7:
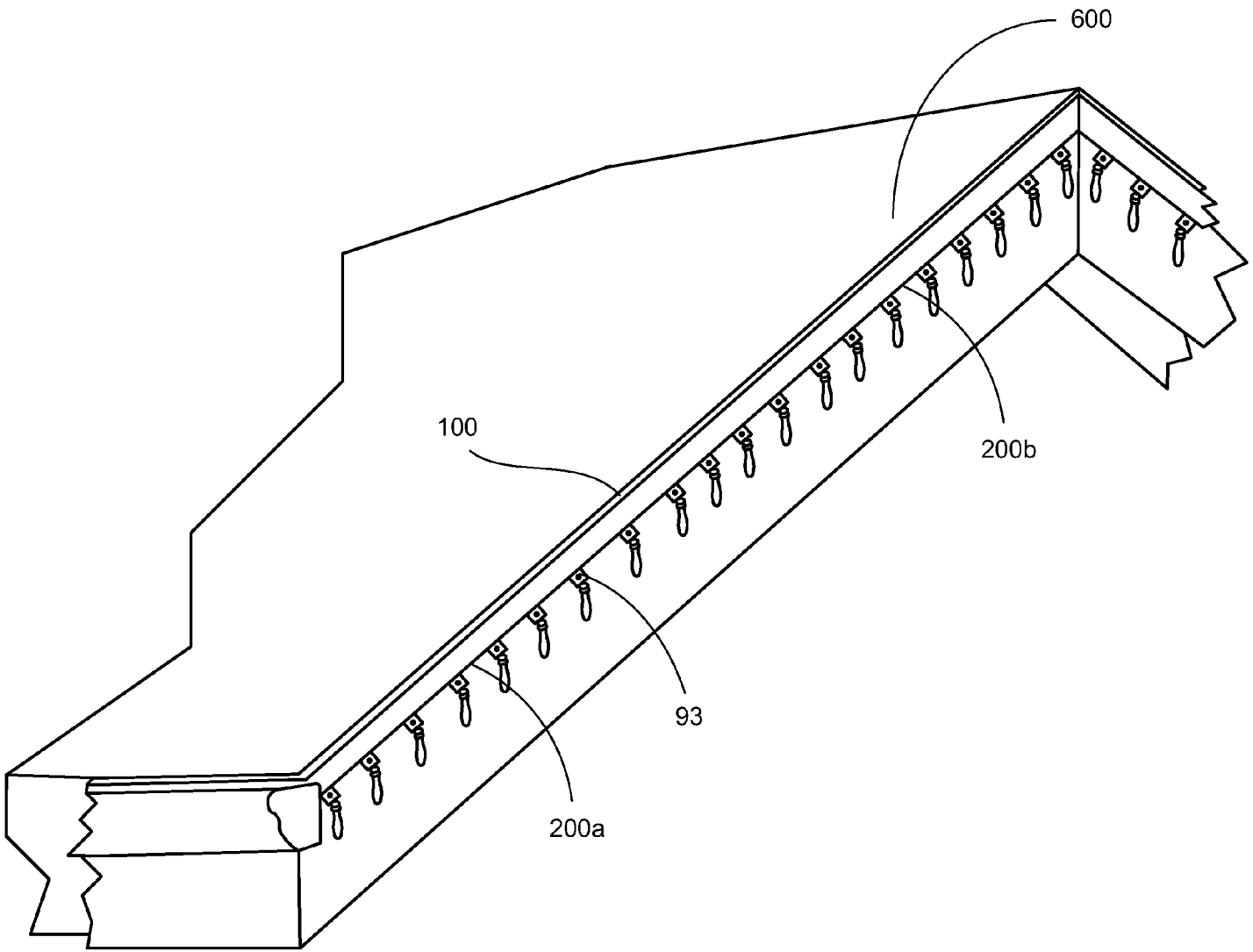
FIG. 7 illustrates a perspective view of an exemplary embodiment of an integrated housing mounting system in use.

FIG. 7 illustrates a perspective view of integrated housing mounting system 600 in use on a roof peak. Mounting system 600 is comprised of mount components 100, rail components 200, connector components 400 (not visible), insertion components 300 (not visible) and optional end cap components (not visible).

To assemble mounting system 600, rail components 200 are connected by connector component 400. One end of slide member 410 of connector component 400 is slid into hollow channel 210 of rail component 200*a* and pins 33*a*, 33*b* are pressed into apertures 37*c*, 37*d* of rail component 200*a*. The other end of slide member 410 is slid into hollow channel 210 of rail component 200*b* and pins 33*c*, 33*d* are pressed into apertures 37*e*, 37*f* of rail component 200*b*.

Once the rail components are connected, a light strand or other ornamentation is attached by placing a hook or other securing device through one or more accessory mount holes 93. Connected rail components 200 and affixed ornamentation are slid through opening 65 of mount components 100 by hooking a pole, string or wire through guiding hole 88. Optional end caps may be added to the outer ends of mount component 100 to enclose opening 65.

In the embodiment shown, each rail component 200 has a length of 1 foot with accessory mount holes 93 centered lengthwise resulting in accessory mount holes spaced 6 inches apart, and connector component 400 has a length of 3 inches. In the embodiment shown, mount component 100*b* has a length of 1 foot. In other embodiments, rail components, mount components and connector components are shorter or longer and/or have a fewer or greater number of accessory mount holes or varying spacing of apertures and accessory mount holes.

What is claimed is:

1. An integrated housing mounting system comprised of:

at least one elongated rail component comprised of:

a first side having a structural contour;

a second side having a structural contour;

a curved upper portion which connects said first side and said second side;

a curved lower portion connected to said second side, said curved lower portion further includes two friction reducing ridges which protrude from said curved lower portion;

wherein said first side, said second side, said curved upper portion, and said curved lower portion form a hollow channel; and a flattened vertical portion attached to said first side, said flattened vertical portion positioned to create a slot between said flattened vertical portion and said curved lower portion;

wherein said flattened vertical portion further includes at least one accessory mount hole for mounting ornamentation; and at least one mount component having a contoured track mount housing adapted to receive said at least one elongated rail component, said contoured track mount housing further includes an opening adapted to receive said flattened vertical portion.

2. The system of claim 1 wherein said first side and said second side are curved inward.

3. The system of claim 1 wherein said flattened vertical portion further includes a plurality of apertures for connecting said at least one elongated rail component to a second elongated rail component.

4. The system of claim 1 wherein said flattened vertical portion further includes at least one guiding hole.

5. The system of claim 1 wherein said at least one elongated rail component further includes a plurality of pivotal joints to facilitate insertion into said contoured track mount housing.

6. The system of claim 1 wherein said contoured track mount housing is oval shaped.

7. The system of claim 1 wherein said mount component further includes a horizontal top portion connected to a vertical back portion.

8. The system of claim 7 wherein said horizontal top portion further includes a plurality of apertures for securing said mount component to a building.

9. The system of claim 7 wherein said vertical back portion further includes a plurality of apertures for securing said mount component to a building.

10. The system of claim 7 wherein said horizontal top portion and said vertical back portion are placed at a 90 degree angle to form a drip edge.

11. The system of claim 7 wherein said horizontal top portion and said vertical back portion are placed at an angle ranging from 95 to 120 degrees to form a gutter apron.

12. The system of claim 1 wherein said mount component further includes a corner portion and two side portions.

13. The system of claim 12 wherein said corner portion forms a 90 degree angle to fit an outside corner of a building.

14. The system of claim 12 wherein said corner portion is curved to fit an inside corner of a building.

15. The system of claim 12 wherein said side portions further include apertures for securing said mount component to a building.

16. The system of claim 12 wherein said corner portion further includes at least one access opening for insertion of said at least one elongated rail component.

17. The system of claim 1 wherein said contoured track mount housing protects said at least one elongated rail component from weather elements allowing said at least one elongated rail component to be inserted and removed in all weather conditions.

* * * * *